US006477231B2

(12) United States Patent
Snyder et al.

(10) Patent No.: US 6,477,231 B2
(45) Date of Patent: Nov. 5, 2002

(54) THERMAL ENERGY TRANSFER DEVICE AND X-RAY TUBES AND X-RAY SYSTEMS INCORPORATING SAME

(75) Inventors: Douglas J. Snyder, Brookfield, WI (US); Craig Higgins, Milwaukee, WI (US); John Warren, Waukesha, WI (US); Mark Vermilyea, Niskayuna, NY (US); Thomas Ebben, Sullivan, WI (US)

(73) Assignee: General Electric Company, Schenectady, NY (US)

( * ) Notice: Subject to any disclaimer, the term of this patent is extended or adjusted under 35 U.S.C. 154(b) by 70 days.

(21) Appl. No.: 09/751,631

(22) Filed: Dec. 29, 2000

(65) Prior Publication Data

US 2002/0085675 A1 Jul. 4, 2002

(51) Int. Cl.[7] ..... H01J 35/10
(52) U.S. Cl. ..... 378/130; 378/141; 378/127
(58) Field of Search ..... 378/130, 141, 378/127, 121, 144

(56) References Cited

U.S. PATENT DOCUMENTS 3,694,685 A * 9/1972 Houston ..... 313/60
4,165,472 A * 8/1979 Wittry ..... 313/35
4,455,504 A * 6/1984 Iversen ..... 313/30
4,622,687 A * 11/1986 Whitaker et al. ..... 378/130
4,674,109 A * 6/1987 Ono ..... 378/130
4,943,989 A * 7/1990 Lounsberry et al. ..... 378/130
4,945,562 A * 7/1990 Staub ..... 378/130
4,969,172 A * 11/1990 Fengler et al. ..... 378/125
5,091,927 A * 2/1992 Golitzer et al. ..... 378/130
5,416,820 A * 5/1995 Weil et al. ..... 378/130
5,579,364 A * 11/1996 Osaka et al. ..... 378/130
5,652,778 A * 7/1997 Tekriwal ..... 378/132
5,673,301 A * 9/1997 Tekriwal ..... 378/130
5,995,584 A * 11/1999 Bhatt ..... 378/125
6,021,174 A * 2/2000 Campbell ..... 378/125

* cited by examiner

*Primary Examiner*—Drew A. Dunn
(74) *Attorney, Agent, or Firm*—Dougherty, Clements & Hofer; Christopher L. Bernard, Esq.

(57) ABSTRACT

An x-ray generating device or system include an anode assembly including a target; a cathode assembly disposed at a distance from the anode assembly, the cathode assembly configured to emit electrons that strike the target of the anode assembly, producing x-rays and residual energy; a heat receptor, positioned between the anode assembly and a bearing assembly supporting the anode assembly, for absorbing an amount of the residual energy; and a heat exchanger, in thermal communication with the heat receptor, for carrying a cooling medium and conducting an amount of the residual energy absorbed by the heat receptor away from the heat receptor.

70 Claims, 4 Drawing Sheets

THERMAL ENERGY TRANSFER DEVICE AND X-RAY TUBES AND X-RAY SYSTEMS INCORPORATING SAME

BACKGROUND OF THE INVENTION

The present invention relates generally to a thermal energy transfer device for use within an x-ray generating device or x-ray system and, more specifically, to a heat receptor for use within an x-ray tube or x-ray system.

Typically, an x-ray generating device, referred to as an x-ray tube, includes opposed electrodes enclosed within a cylindrical vacuum vessel. The vacuum vessel is commonly fabricated from glass or metal, such as stainless steel, copper, or a copper alloy. The electrodes include a cathode assembly positioned at some distance from the target track of a rotating, disc-shaped anode assembly. Alternatively, such as in industrial applications, the anode assembly may be stationary. The target track, or impact zone, of the anode is generally fabricated from a refractory metal with a high atomic number, such as tungsten or a tungsten alloy. Further, to accelerate electrons used to generate x-rays, a voltage difference of about 60 kV to about 140 kV is commonly maintained between the cathode and anode assemblies. The hot cathode filament emits thermal electrons that are accelerated across the potential difference, impacting the target zone of the anode assembly at high velocity. A small fraction of the kinetic energy of the electrons is converted to high-energy electromagnetic radiation, or x-rays, while the balance is contained in back-scattered electrons or converted to heat. The x-rays are emitted in all directions, emanating from a focal spot, and may be directed out of the vacuum vessel along a focal alignment path. In an x-ray tube having a metal vacuum vessel, for example, an x-ray transmissive window is fabricated into the vacuum vessel to allow an x-ray beam to exit at a desired location. After exiting the vacuum vessel, the x-rays are directed along the focal alignment path to penetrate an object, such as a hum;an anatomical part for medical examination and diagnostic purposes. The x-rays transmitted through the object are intercepted by a detector or film, and an image of the internal anatomy of the object is formed. Likewise, industrial x-ray tubes may be used, for example, to inspect metal parts for cracks or to inspect the contents of luggage at an airport.

Since the production of x-rays in a medical diagnostic x-ray tube is by its very nature an inefficient process, the components in the x-ray tube operate at elevated temperatures. For example, the temperature of the anode's focal spot may run as high as about 2,700 degrees C., while the temperature in other parts of the anode may run as high as about 1,800 degrees C. The thermal energy generated during tube operation is typically transferred from the anode, and other components, to the vacuum vessel. The vacuum vessel, in turn, is generally enclosed in a casing filled with a circulating cooling fluid, such as dielectric oil or air, that removes the thermal energy from the x-ray tube. The casing also supports and protects the x-ray tube and provides a structure for mounting the tube. Additionally, the casing is commonly lined with lead to shield stray radiation.

As discussed above, the primary electron beam generated by the cathode of an x-ray tube deposits a large heat load in the anode target. In fact, the target glows red-hot in operation. Typically, less than 1% of the primary electron beam energy is converted into x-rays, the balance being converted to thermal energy. This thermal energy from the hot target is conducted and radiated to other components within the vacuum vessel. The fluid circulating around the exterior of the vacuum vessel transfers some of this thermal energy out of the system. However, the high temperatures caused by this thermal energy subject the x-ray tube components to high thermal stresses that are problematic in the operation and reliability of the x-ray tube. This is true for a number of reasons. First, the exposure of components in the x-ray tube to cyclic high temperatures may decrease the life and reliability of the components. In particular, the anode assembly typically includes a shaft that is rotatably supported by a bearing assembly. The bearing assembly is very sensitive to high heat loads. Overheating of the bearing assembly may lead to increased friction, increased noise, and to the ultimate failure of the bearing assembly. Due to the high temperatures present, the balls of the bearing assembly are typically coated with a solid lubricant. A preferred lubricant is lead, however, lead has a low melting point and is typically not used in a bearing assembly exposed to operating temperatures above about 330 degrees C. Because of this temperature limit, an x-ray tube with a bearing assembly including a lead lubricant is limited to shorter, less powerful x-ray exposures. Above about 450 degrees C., silver is generally the lubricant of choice, allowing for longer, more powerful x-ray exposures. Silver, however, increases the noise generated by the bearing assembly.

The high temperatures encountered within an x-ray tube also reduce the scanning performance or throughput of the tube, which is a function of the maximum operating temperature, and specifically the bearing temperature, of the tube. As discussed above, the maximum operating temperature of an x-ray tube is a function of the power and length of x-ray exposure, as well as the time between x-ray exposures. Typically, an x-ray tube is designed to operate at a certain maximum temperature, corresponding to a certain heat capacity and a certain heat dissipation capability for the components within the tube. These limits are generally established with current x-ray routines in mind. However, new routines are continually being developed, routines that may push the limits of existing x-ray tube capabilities. Techniques utilizing higher instantaneous power, longer x-ray exposures, and increased patient throughput are in demand to provide better images and greater patient care. Thus, there is a need to remove as much heat as possible from existing x-ray tubes, as quickly as possible, in order to increase x-ray exposure power and duration before reaching tube operational limits.

The prior art has primarily relied upon removing thermal energy from the x-ray tube through the cooling fluid circulating around the vacuum vessel. It has also relied upon blocking heat to the bearing assembly with high thermal resistance attachments to the target or by placing low emissivity thermal radiation shields between the bearing assembly and the inner diameter of the target. These approaches have been marginally effective, however, they are limited. The cooling fluid methods, for example, are not adequate when the anode end of the x-ray tube cannot be sufficiently exposed to the circulating fluid. Likewise, the shielding methods are generally not adequate as thermal radiation shields have a tendency to heat up, radiating heat to the rotor assembly of the x-ray tube. Thus, the target attachments must be even thinner to prevent heat from being conducted to the bearings. These thin attachments may cause rotor-dynamic problems. Further, placing a thermal radiation shield in the inner bore of the target may also reflect heat back to the target, limiting the performance of the x-ray tube. The shielding methods, in general, do nothing to actually remove heat from an x-ray tube.

BRIEF SUMMARY OF THE INVENTION

The present invention overcomes the problems discussed above and permits greater x-ray tube throughput by providing cooler running bearings and a cooler target at a given tube power. The present invention also reduces thermal growth of the anode, increasing the life and efficiency of the x-ray tube and improving image quality.

In one embodiment, a thermal energy transfer device for use within an x-ray generating device having an anode rotatably supported by a bearing assembly, the x-ray device generating x-rays and residual energy in the form of heat, includes a heat receptor, positioned between the anode and the bearing assembly, for absorbing an amount of the residual energy; and a heat exchanger, in thermal communication with the heat receptor and having an inlet end and an exit end, for carrying a cooling medium and convecting the residual energy absorbed by the heat receptor away from the heat receptor.

In another embodiment, an x-ray generating device includes an anode assembly including a target and a shaft; a bearing structure rotatably supporting the shaft; a cathode assembly disposed at a distance from the anode assembly, the cathode assembly configured to emit electrons that strike the target of the anode assembly and produce x-rays and residual energy in the form of heat; a heat receptor positioned between the anode assembly and the bearing structure, the heat receptor for absorbing an amount of the residual energy; and a heat exchanger, in thermal communication with the heat receptor and having an inlet end and an exit end, the heat exchanger for carrying a cooling medium and conducting an amount of the residual energy absorbed by the heat receptor away from the heat receptor.

In a further embodiment, an x-ray system includes a vacuum vessel having an inner surface forming a vacuum chamber; an anode assembly disposed with the vacuum chamber, the anode assembly including a target; a cathode assembly disposed within the vacuum chamber at a distance from the anode assembly, the cathode assembly configured to emit electrons that strike the target of the anode assembly and produce x-rays and residual energy, said x-rays directed along a focal alignment path;

a rotatable shaft coupled to the vacuum vessel; a bearing assembly comprising a lubricating medium disposed within the vacuum chamber, the bearing assembly providing for rotational movement of the shaft; an annular heat receptor made of a thermally conductive material positioned between the anode assembly and the bearing assembly, the heat receptor having an inner surface with an inner diameter and an outer surface with an outer diameter, the heat receptor for absorbing an amount of the residual energy; and an annular heat exchanger in thermal communication with the heat receptor, the heat exchanger having an inlet and an exit for carrying a cooling medium, the heat exchanger for conducting an amount of the residual energy absorbed by the heat receptor away from the heat receptor.

DETAILED DESCRIPTION OF THE INVENTION

The present invention seeks to remove excess thermal energy from an x-ray tube or x-ray system by positioning a heat receptor and a heat exchanger within the anode assembly of the x-ray tube. This thermal energy transfer device is positioned between the anode target and the bearing assembly, providing a cooler target and cooler running bearings, increasing the life, efficiency, and image quality of the x-ray tube or x-ray system.

Figure 1:
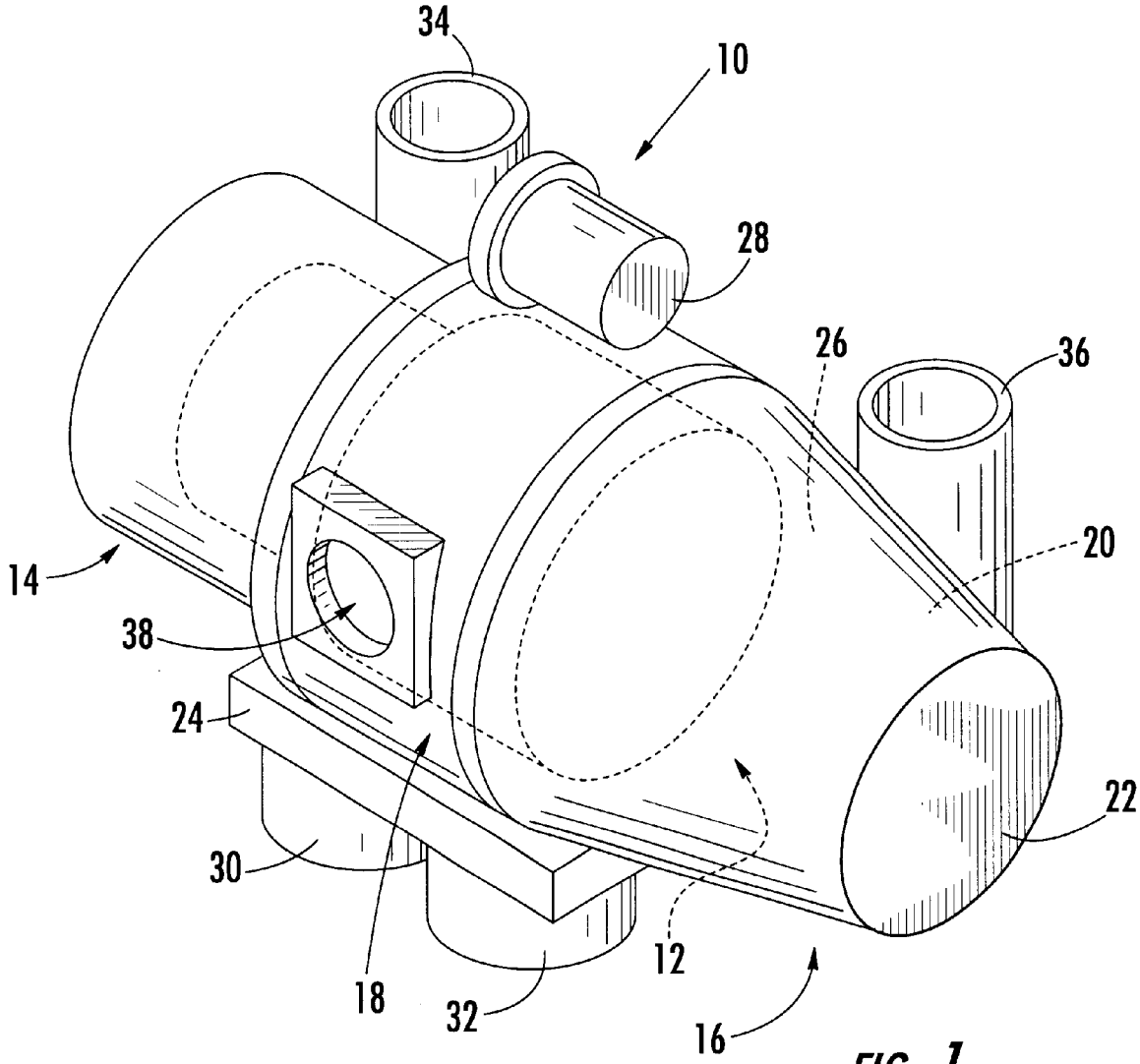
FIG. 1 is a perspective view of an x-ray tube assembly unit that contains an x-ray generating device, or x-ray tube.

Referring to FIG. 1, one embodiment of an x-ray tube assembly unit 10 that contains an x-ray generating device, or x-ray tube 12, includes an anode end 14, a cathode end 16, and a center section 18 positioned between the anode end 14 and the cathode end 16. The x-ray tube 12 is disposed within the center section 18 of the assembly unit 10 in a fluid-filled chamber 20 formed by a casing 22. The casing 22 may, for example, be made of aluminum. The chamber 20 may, for example, be filled with dielectric oil that circulates throughout the casing 22, cooling the operational x-ray tube 12 and insulating the casing 22 from the high electrical charges within the x-ray tube 12. The casing 22 may, optionally, be lead-lined. The assembly unit 10 also, preferably, includes a radiator 24, positioned to one side of the center section 18, that cools the circulating fluid 26. The fluid 26 may be moved through the chamber 20 and radiator 24 by an oil pump 28. Preferably, a pair of fans 30, 32 are coupled to the radiator 24, providing a cooling air flow to the radiator 24 as the hot fluid 26 flows through it. Optionally, electrical connections to the assembly unit 10 are provided through an anode receptacle 34 and a cathode receptacle 36. X-rays are emitted from the x-ray tube assembly unit 10 through an x-ray transmissive window 38 in the casing 22 at the center section 18.

Figure 2:
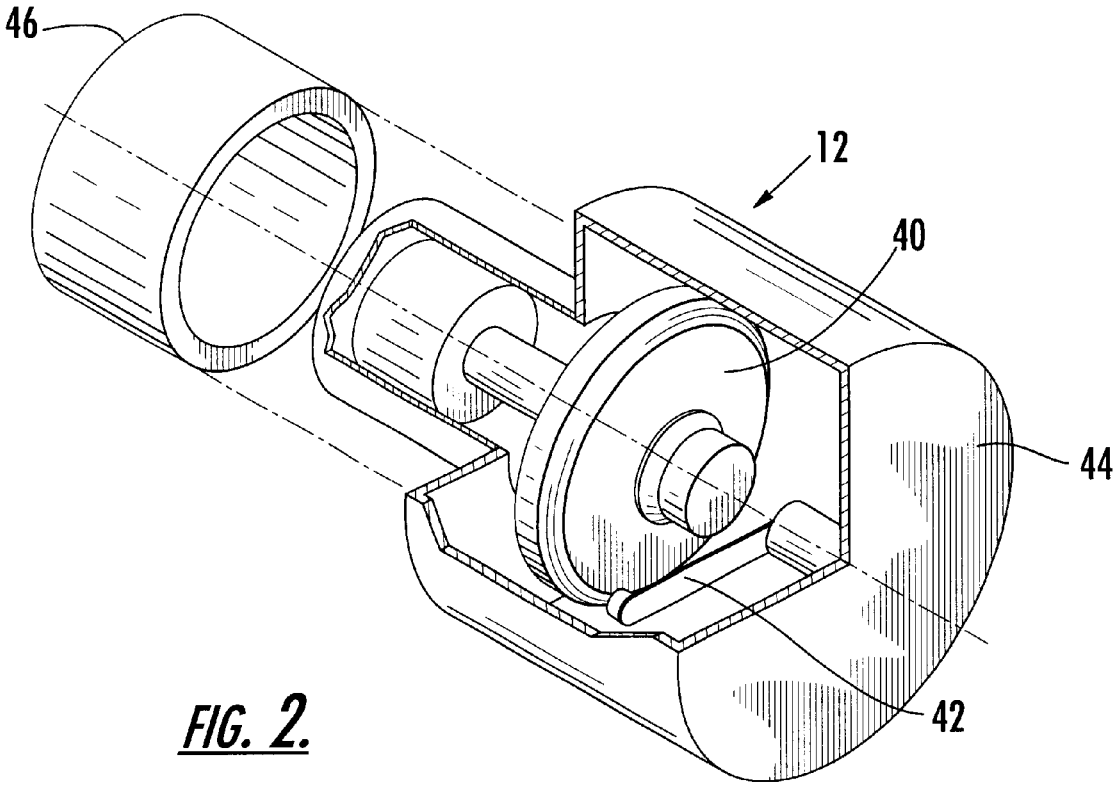
FIG. 2 is a sectional perspective view of the x-ray tube of FIG. 1 with the stator exploded to reveal a portion of the anode assembly.

Referring to FIG. 2, the x-ray generating device, or x-ray tube 12, includes an anode assembly 40 and a cathode assembly 42 disposed within a vacuum vessel 44. The vacuum vessel 44 may, for example, be made of stainless steel, copper, or glass. The anode assembly 40 may optionally, for medical applications, be rotating. A stator 46 is positioned over the vacuum vessel 44 adjacent to the anode assembly 40. Upon the energization of an electrical circuit connecting the anode assembly 40 and the cathode assembly 42, which produces a potential difference of about 60 kV to about 140 kV between the anode assembly 40 and the cathode assembly 42, electrons are directed from the cathode assembly 42 to the anode assembly 40. The electrons strike a focal spot located within a target zone of the anode assembly 40 and produce high-frequency electromagnetic waves, or x-rays, back-scattered electrons, and residual energy. The residual energy is absorbed by the components within the x-ray tube 12 as heat. The x-rays are directed through the vacuum and out of the casing 22 (FIG. 1) through the transmissive window 38 (FIG. 1), toward an object to be imaged, along a focal alignment path. The transmissive window 38 may be made of beryllium, titanium, aluminum, or any other suitable x-ray transmissive material. The transmissive window 38, and optionally an associated aperture and filter, collimates the x-rays, thereby reducing the radiation dosage received by, for example, a patient. As an illustration, in computed tomography applications, the useful diagnostic energy range for x-rays is from about 60 keV to about 140 keV. An x-ray system utilizing an x-ray tube may also be used for mammography, radiography, angiography, fluoroscopy, vascular, mobile, and industrial x-ray applications, among others.

Figure 3:
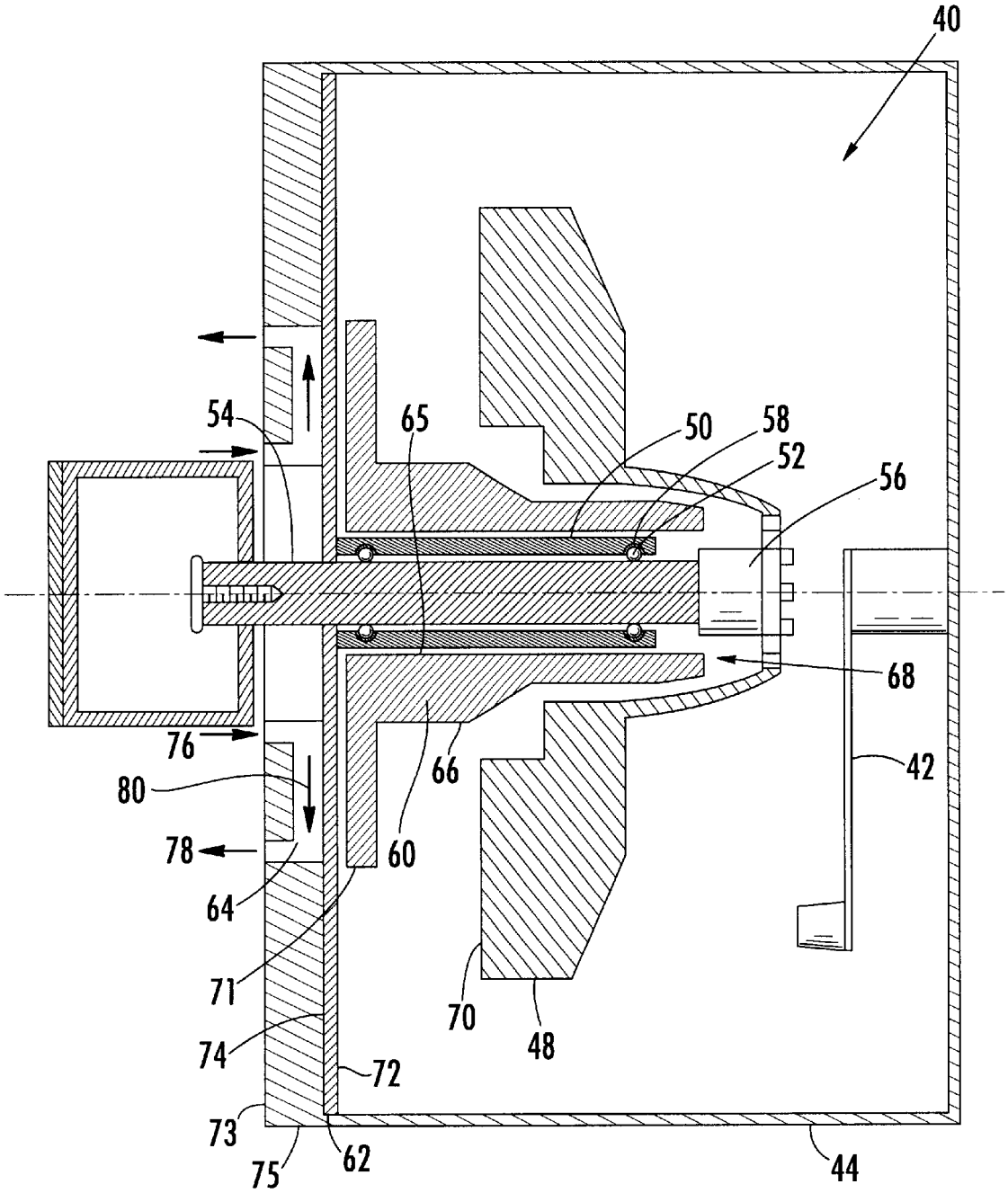
FIG. 3 is a cross-sectional view of one embodiment of an x-ray tube including the thermal energy transfer device of the present invention.

Referring to FIG. 3, one embodiment of the anode assembly 40 of the x-ray generating device typically includes a target 48, a bearing support 50, bearing balls 52, and bearing races 58. The target 48 is a metallic disk made of a refractory metal, optionally with graphite brazed to it. The target 48 is preferably fabricated from a refractory metal with a high atomic number, such as tungsten or a tungsten alloy. The target 48 provides a surface that electrons from the cathode assembly 42 strike. Optionally, the target 48 rotates by the rotation of a shaft 54 coupled to the target 48 by a connector 56. The rotation of the target 48 distributes the area of the target 48 that is impacted by electrons. The bearing support 50 is a cylindrical tube that provides support for the anode assembly 40. Bearing balls 52 and bearing races 58 are disposed within the bearing support 50 and provide for rotational movement of the target 48 by providing for rotational movement of the shaft 54. The bearing balls 52 and bearing races 58 are typically made of tool steel, or any other suitable material, and may become softened and even deformed by excessive heat. As a result, distributing heat away from the bearing balls 52 and bearing races 58 is important to the proper rotational movement of the target 48 and, therefore, the proper operation of the x-ray tube 12 (FIGS. 1 and 2).

As discussed above, the primary electron beam generated by the cathode assembly 42 of an x-ray tube 12 deposits a large heat load in the target 48. In fact, the target 48 glows red-hot in operation. Typically, less than 1% of the primary electron beam energy is converted into x-rays, the balance being converted to thermal energy.

This thermal energy from the hot target 48 is conducted and radiated to other components within the vacuum vessel 44. The fluid 26 (FIG. 1) circulating around the exterior of the vacuum vessel 44 transfers some of this thermal energy out of the system. However, the high temperatures caused by this energy subject the x-ray tube 12 and its components to high thermal stresses that are problematic in the operation and reliability of the x-ray tube 12 and that reduce its throughput. With respect to an x-ray tube's bearing assembly 50, 52, 58, due to the high temperatures present, the bearing balls 52 are typically coated with a solid lubricant. A preferred lubricant is lead, however, lead has a low melting point and is typically not used in an assembly exposed to operating temperatures above about 330 degrees C. Because of this temperature limit, an x-ray tube 12 with a bearing assembly 50, 52, 58 including a lead lubricant is limited to shorter, less powerful x-ray exposures. Above about 450 degrees C., silver is generally the lubricant of choice, allowing for longer, more powerful x-ray exposures. Silver, however, increases the noise generated by the bearing assembly 50, 52, 58. Higher-temperature lubricants could also be used, ensuring that the bearing assembly 50, 52, 58 operates within temperature specifications.

Referring again to FIG. 3, a thermal energy transfer device for removing thermal energy from an x-ray tube or x-ray system includes a heat receptor 60 and a heat exchanger 64. The heat receptor 60 is an annular structure, having an inner surface 65 with an inner diameter and an outer surface 66 with at least one outer diameter. The inner surface 65 has an inner diameter greater than or about equal to the outer diameter of the bearing support 50, such that the heat receptor 60 may fit over or mate with the bearing support 50. The outer surface 66 of the heat receptor 60 may have a plurality of outer diameters corresponding to variations in the inner diameters of the adjacent structures of the anode assembly 40. The heat receptor 60 may be made of copper or any other suitable thermally conductive material, such as aluminum or a carbon composite. The heat receptor 60 may be positioned partially within and adjacent to the inner bore 68 of the anode assembly 40. Alternatively, for an anode assembly 40 not having an inner bore 68, the heat receptor 60 may be positioned adjacent to at least a portion of the inner diameter and back surface 70 of the anode target 48, i.e. the surface not impacted by electrons from the cathode assembly 42. The bearing assembly 50, 52, 58 may be partially disposed within, and preferably is completely disposed within, the inner diameter of the heat receptor 60. Thus, the heat receptor 60 is positioned between the anode assembly 40, and specifically the anode target 48, and the bearing support 50, bearing balls 52, bearing races 58, and shaft 54. Preferably, the inner surface 65 of the heat receptor 60 has a low emissivity relative to its outer surface 66, which has a relatively high emissivity or thermal conductance, thus maximizing the amount of heat collected from the inner bore 68 of the anode assembly 40, while minimizing the amount of heat radiated to the bearing assembly 50, 52, 58. This emissivity difference is achieved by, for example, coating, blasting, etching, or electroplating one or both surfaces 65, 66 of the heat receptor 60. The inner surface 65 and outer surface 66 of the heat receptor 60 may also, optionally, include different materials. As an illustration, the inner surface 65 may have an emissivity in the range of about 0.02 to about 0.2 and the outer surface 66 may have an emissivity in the range of about 0.3 to about 1.0. Other emissivity ranges are, however, acceptable. Optionally, the portion of the heat receptor 60 not positioned within and adjacent to the inner bore 68 of the anode assembly 40, such as the flange portion 71 that extends radially outward from one end of the heat receptor 60, may be positioned adjacent to the back surface 70 of the anode assembly 40 such that it collects heat from the back surface 70 of the anode assembly 40 and, specifically, the anode target 48. The flange portion 71 may radially extend to be partially or completely positioned between the back surface 70 of the target 48 and the anode end 73 of the vacuum vessel 44. Further, the heat receptor 60 may include an annular heat pipe or a plurality of axially-aligned linear heat pipes arranged around and adjacent to the bearing assembly 50, 52, 58 within the inner bore 68 of the anode assembly 40.

Figure 4:
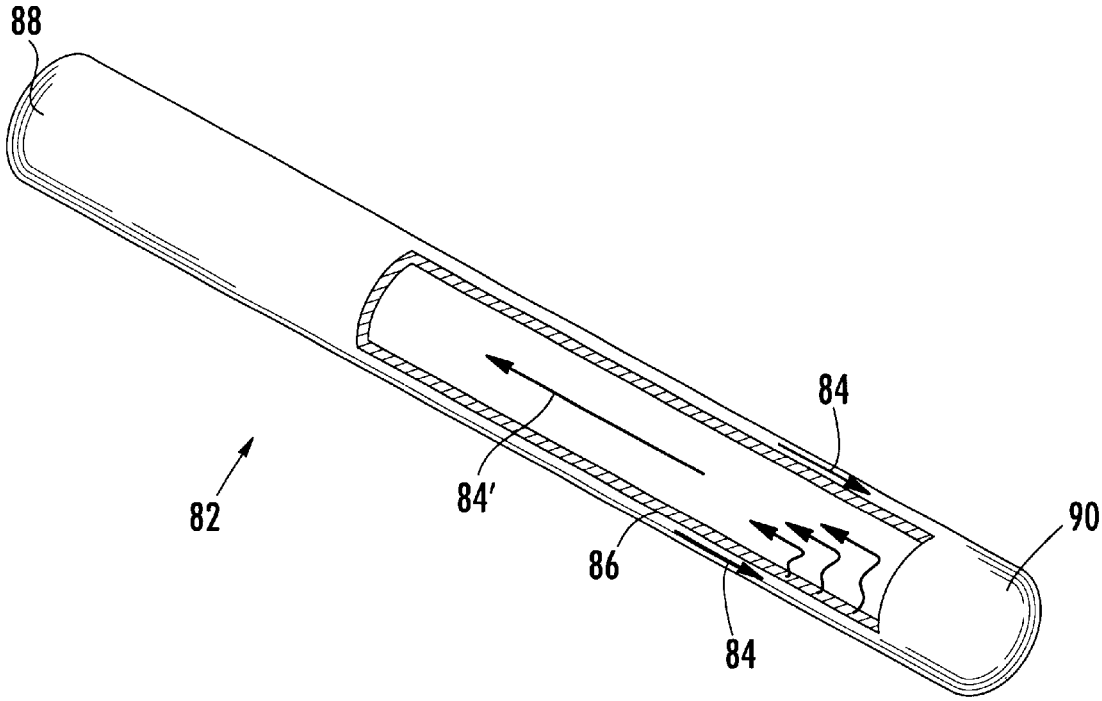
FIG. 4 is a perspective view of a heat pipe.

Referring to FIG. 4, one embodiment of a linear heat pipe 82 includes an evacuated, sealed metal pipe partially filled with a working fluid 84. A heat pipe 82 may be made of, for example, copper, tungsten, stainless steel, or any other suitable high temperature, thermally conductive material. A heat pipe 82 may contain, for example, water, alcohol, nitrogen, ammonia, sodium, or any other suitable working fluid spanning the temperature range from cryogenic to molten lithium. Heat pipes have found wide application in space-based, electronics cooling, and other high heat-flux applications. For example, they may be found in satellites, laptop computers, and solar power generators. Heat pipes have the ability to dissipate very high heat fluxes and heat loads through small cross sectional areas. They have a very large effective thermal conductivity, more than about two orders of magnitude or about 10 to about 10,000 times larger than a comparable solid copper conductor, and may move a large amount of heat from source to sink. Advantageously, heat pipes are completely passive and are used to transfer heat from a source to a sink with minimal temperature gradients, or to isothermalized surfaces. A heat pipe 82 utilizes a capillary wick structure 86, allowing it to operate against gravity by transferring working fluid 84 from a condenser end 88 to an evaporator end 90. In the present invention, heat from the inner bore 68 (FIG. 3) of the anode assembly 40 (FIG. 3) enters the evaporator end 90 of the heat pipe 82 where the working fluid 84 is evaporated, creating a pressure gradient in the pipe(s) 82. The pressure gradient forces the resulting vapor 84' through the hollow core of the heat pipe(s) 82 to the cooler condenser end 88 where the vapor 84' condenses and releases its latent heat. The fluid 84 is then wicked back by capillary forces through the capillary wick structure 86 to the evaporator end 90 and the cycle continues.

Referring again to FIG. 3, the heat exchanger 64 is, preferably, an annular structure, such as a ring-shaped channel, positioned adjacent to and in thermal communication with the heat receptor 60. The heat exchanger 64 may be integrally formed within the wall 75 of the anode end 73 of the vacuum vessel 44. Alternatively, the heat exchanger 64 may be partially defined by a cooling plate 62 including an inner surface 72, positioned adjacent to and in thermal communication with the heat receptor 60, and an outer surface 74, positioned adjacent to and in thermal communication with the heat exchanger 64. The cooling plate 62 may absorb heat from the heat receptor 60, the cooling plate 62 corivectively cooled by a fluid flowing through the heat exchanger 64. The cooling plate may be made of, for example, stainless steel and is generally only a few millimeters thick. Typically, the heat receptor 60 is brazed or welded to the cooling plate 62 to minimize thermal resistance, however this is not critical. To enhance the convective cooling of the cooling plate 62, and therefore the heat receptor 60, fins or other protrusions may be brazed or welded to, or integrally formed with, the outer surface 74 of the cooling plate 62. Optionally, the heat exchanger 64 may also include a plurality of radially-aligned linear channels. The heat exchanger 64 has at least one inlet 76 and at least one exit 78 for circulating a cooling medium 80 through the heat exchanger 64. The cooling medium 80 may be, for example, water, water with glycol, oil, or any other suitable fluid. The cooling medium 80 may be the same fluid as the fluid 26 (FIG. 1) flowing through the casing 22 (FIG. 1) or it may be a different fluid, pumped in from outside of the casing 22. The cooling medium 80 convectively cools the cooling plate 62, absorbing its heat, and thereby transferring the heat away from the cooling plate 62, the heat receptor 60, and the x-ray tube 12 (FIGS. 1 and 2). In combination, the heat receptor 60 and the heat exchanger 64, together comprising the thermal energy transfer device, may eliminate about 10% to about 30% of the residual thermal energy of the x-ray tube 12, i.e. about 10% to about 30% of the total power of the x-ray system.

Although the present invention has been described with reference to preferred embodiments, other embodiments may achieve the same results. Variations and modifications to the present invention will be apparent to those skilled in the art and the following claims are intended to cover all such equivalents.

What is claimed is:

1. A thermal energy transfer device for use within an x-ray generating device having an anode rotatably supported by a bearing assembly, the x-ray device generating x-rays and residual energy in the form of heat, the thermal energy transfer device comprising:

a heat receptor, positioned between the anode and the bearing assembly, for absorbing an amount of the residual energy;

wherein the heat receptor has a first end and a second end and further comprises an annular structure having an inner surface with an inner diameter and an outer surface with an outer diameter; and a heat exchanger, in thermal communication with the heat receptor and having an inlet end and an exit end, for carrying a cooling medium and conducting the residual energy absorbed by the heat receptor away from the heat receptor.

2. The thermal energy transfer device of claim 1, further comprising a cooling plate in thermal communication with the heat receptor, the cooling plate comprising a thermally conductive material and having an inner surface and an outer surface, the inner surface proximal to the heat receptor and the outer surface proximal to the heat exchanger.

3. The thermal energy transfer device of claim 2, wherein the outer surface of the cooling plate further comprises a plurality of raised fin structures.

4. The thermal energy transfer device of claim 1, wherein the x-ray generating device has a total residual energy, wherein Q is the residual energy absorbed by the heat receptor and transferred away from the x-ray generating device by the thermal energy transfer device, and wherein Q is in the range of about 10% to about 30% of the total residual energy.

5. The thermal energy transfer device of claim 1, wherein the inner diameter of the heat receptor is sized to permit the bearing assembly of the x-ray generating device to be disposed within the heat receptor.

6. The thermal energy transfer device of claim 1, wherein the outer diameter of the heat receptor is sized to permit the heat receptor to be disposed within an inner bore of the anode of the x-ray generating device.

7. The thermal energy transfer device of claim 1, wherein the inner surface of the heat receptor has a lower thermal emissivity than the outer surface of the heat receptor.

8. The thermal energy transfer device of claim 1, wherein the outer surface of the heat receptor has a higher thermal emissivity than the inner surface of the heat receptor.

9. The thermal energy transfer device of claim 1, wherein the heat receptor comprises a thermally conductive material.

10. The thermal energy transfer device of claim 1, wherein the heat receptor further comprises an annular heat pipe.

11. The thermal energy transfer device of claim 10, wherein the annular heat pipe comprises an evacuated sealed metal chamber partially filled with a fluid.

12. The thermal energy transfer device of claim 10, wherein the annular heat pipe comprises an evaporator end and a condenser end, the evaporator end positioned proximal to the first end of the heat receptor and the condenser end positioned proximal to the second end of the heat receptor.

13. The thermal energy transfer device of claim 12, wherein the annular heat pipe further comprises internal walls having a capillary wick structure, the capillary wick structure providing for the transfer of a fluid between the condenser end and the evaporator end of the annular heat pipe.

14. The thermal energy transfer device of claim 1, wherein the heat receptor further comprises a plurality of axially-aligned linear heat pipes disposed within the heat receptor.

15. The thermal energy transfer device of claim 14, wherein each of the plurality of heat pipes comprises an evacuated sealed metal chamber partially filled with a fluid.

16. The thermal energy transfer device of claim 14, wherein each of the plurality of heat pipes comprises an evaporator end and a condenser end, the evaporator end positioned proximal to the first end of the heat receptor and the condenser end positioned proximal to the second end of the heat receptor.

17. The thermal energy transfer device of claim 16, wherein each of the plurality of heat pipes further comprises internal walls having a capillary wick structure, the capillary wick structure providing for the transfer of a fluid between the condenser end and the evaporator end of each of the plurality of heat pipes.

18. The thermal energy transfer device of claim 1, wherein the heat exchanger is annular.

19. The thermal energy transfer device of claim 1, wherein the cooling medium comprises a fluid selected from the group consisting of water, water with glycol, and oil.

20. A thermal energy transfer device for use within an x-ray generating device having an anode rotatably supported by a bearing assembly, the x-ray device generating x-rays and residual energy in the form of heat, the thermal energy transfer device comprising:

an annular heat receptor comprising a thermally conductive material, positioned between the anode and the bearing assembly, the heat receptor having a first end and a second end and further having an inner surface with an inner diameter and an outer surface with an outer diameter, the heat receptor for absorbing an amount of the residual energy; and an annular heat exchanger, in thermal communication with the heat receptor and having an inlet end and an exit end, for carrying a cooling medium and conducting the residual energy absorbed by the heat receptor away from the heat receptor.

21. The thermal energy transfer device of claim 20, wherein the x-ray generating device has a total residual energy, wherein Q is the residual energy absorbed by the heat receptor and transferred away from the x-ray generating device by the thermal energy transfer device, and wherein Q is in the range of about 10% to about 30% of the total residual energy.

22. The thermal energy transfer device of claim 20, further comprising a cooling plate in thermal communication with the heat receptor, the cooling plate comprising a thermally conductive material and having an inner surface and an outer surface, the inner surface proximal to the heat receptor and the outer surface proximal to the heat exchanger.

23. The thermal energy transfer device of claim 22, wherein the outer surface of the cooling plate further comprises a plurality of raised fin structures.

24. The thermal energy transfer device of claim 20, wherein the inner diameter of the heat receptor is sized to permit the bearing assembly of the x-ray generating device to be disposed within the heat receptor.

25. The thermal energy transfer device of claim 20, wherein the outer diameter of the heat receptor is sized to permit the heat receptor to be disposed within an inner bore of the anode of the x-ray generating device.

26. The thermal energy transfer device of claim 20, wherein the inner surface of the heat receptor has a lower thermal emissivity than the outer surface of the heat receptor.

27. The thermal energy transfer device of claim 20, wherein the outer surface of the heat receptor has a higher thermal emissivity than the inner surface of the heat receptor.

28. The thermal energy transfer device of claim 20, wherein the heat receptor further comprises an annular heat pipe.

29. The thermal energy transfer device of claim 28, wherein the annular heat pipe comprises an evacuated sealed metal chamber partially filled with a fluid.

30. The thermal energy transfer device of claim 28, wherein the annular heat pipe comprises an evaporator end and a condenser end, the evaporator end positioned proximal to the first end of the heat receptor and the condenser end positioned proximal to the second end of the heat receptor.

31. The thermal energy transfer device of claim 20, wherein the heat receptor further comprises a plurality of axially-aligned linear heat pipes disposed within the heat receptor.

32. The thermal energy transfer device of claim 31, wherein each of the plurality of heat pipes comprises an evacuated sealed metal chamber partially filled with a fluid.

33. The thermal energy transfer device of claim 31, wherein each of the plurality of heat pipes comprises an evaporator end and a condenser end, the evaporator end positioned proximal to the first end of the heat receptor and the condenser end positioned proximal to the second end of the heat receptor.

34. The thermal energy transfer device of claim 20, wherein the cooling medium comprises a fluid selected from the group consisting of water, water with glycol, and oil.

35. An x-ray generating device, comprising:

an anode assembly including a target and a shaft;

a bearing structure rotatably supporting the shaft;

a cathode assembly disposed at a distance from the anode assembly, the cathode assembly configured to emit electrons that strike the target of the anode assembly and produce x-rays and residual energy in the form of heat;

a heat receptor positioned between the anode assembly and the bearing structure, the heat receptor for absorbing an amount of the residual energy;

wherein the heat receptor has a first end and a second end and is an annular structure comprising an inner surface with an inner diameter and an outer surface with an outer diameter; and a heat exchanger, in thermal communication with the heat receptor and having an inlet end and an exit end, the heat exchanger for carrying a cooling medium and conducting an amount of the residual energy absorbed by the heat receptor away from the heat receptor.

36. The x-ray generating device of claim 35, wherein the cooling medium comprises a fluid selected from the group consisting of water, water with glycol, and oil.

37. The x-ray generating device of claim 35, wherein the heat receptor and heat exchanger reduce the operating temperature of the bearing structure by an amount such that lead may be used to lubricate the bearing structure.

38. The x-ray generating device of claim 35, further comprising a vacuum vessel having an inner surface forming a vacuum chamber.

39. The x-ray generating device of claim 35, further comprising a cooling plate in thermal communication with the heat receptor, the cooling plate comprising a thermally conductive material and having an inner surface and an outer surface, the inner surface proximal to the heat receptor and the outer surface proximal to the heat exchanger.

40. The x-ray generating device of claim 35, wherein the inner diameter of the heat receptor is sized to permit the bearing structure to be disposed within the heat receptor.

41. The x-ray generating device of claim 35, wherein the outer diameter of the heat receptor is sized to permit the heat receptor to be disposed within an inner bore of the anode assembly.

42. The x-ray generating device of claim 35, wherein the inner surface of the heat receptor has a lower thermal emissivity than the outer surface of the heat receptor.

43. The x-ray generating device of claim 35, wherein the outer surface of the heat receptor has a higher thermal emissivity than the inner surface of the heat receptor.

44. The x-ray generating device of claim 35, wherein the heat receptor is made of a thermally conductive material.

45. The x-ray generating device of claim 35, wherein the heat receptor further comprises an annular heat pipe.

46. The x-ray generating device of claim 45, wherein the annular heat pipe comprises an evacuated sealed metal chamber partially filled with a fluid.

47. The x-ray generating device of claim 45, wherein the annular heat pipe comprises an evaporator end and a condenser end, the evaporator end positioned proximal to the first end of the heat receptor and the condenser end positioned proximal to the second end of the heat receptor.

48. The x-ray generating device of claim 35, wherein the heat receptor further comprises a plurality of axially-aligned linear heat pipes disposed within the heat receptor.

49. The x-ray generating device of claim 48, wherein each of the plurality of heat pipes comprises an evacuated sealed metal chamber partially filled with a fluid.

50. The x-ray generating device of claim 48, wherein each of the plurality of heat pipes comprises an evaporator end and a condenser end, the evaporator end positioned proximal to the first end of the heat receptor and the condenser end positioned proximal to the second end of the heat receptor.

51. The x-ray generating device of claim 35, wherein the heat exchanger is annular.

52. An x-ray generating device, comprising:

a vacuum vessel having an inner surface forming a vacuum chamber;

an anode assembly including a target and a shaft;

a bearing structure rotatably supporting the shaft;

a cathode assembly disposed at a distance from the anode assembly, the cathode assembly configured to emit electrons that strike the target of the anode assembly and produce x-rays and residual energy in the form of heat;

an annular heat receptor made of a thermally conductive material, positioned between the anode assembly and the bearing structure, the heat receptor having a first end and a second end and comprising an inner surface with an inner diameter and an outer surface with an outer diameter, the heat receptor for absorbing an amount of the residual energy; and an annular heat exchanger, in thermal communication with the heat receptor and having an inlet end and an exit end, the heat exchanger for carrying a cooling medium and conducting an amount of the residual energy absorbed by the heat receptor away from the heat receptor.

53. The x-ray generating device of claim 52, wherein the cooling medium comprises a fluid selected from the group consisting of water, water with glycol, and oil.

54. The x-ray generating device of claim 52, wherein the heat receptor and heat exchanger reduce the operating temperature of the bearing structure by an amount such that lead may be used to lubricate the bearing structure.

55. The x-ray generating device of claim 52, further comprising a cooling plate in thermal communication with the heat receptor, the cooling plate comprising a thermally conductive material and having an inner surface and an outer surface, the inner surface proximal to the heat receptor and the outer surface proximal to the heat exchanger.

56. The x-ray generating device of claim 52, wherein the inner diameter of the heat receptor is sized to permit the bearing structure to be disposed within the heat receptor.

57. The x-ray generating device of claim 52, wherein the outer diameter of the heat receptor is sized to permit the heat receptor to be disposed within an inner bore of the anode assembly.

58. The x-ray generating device of claim 52, wherein the inner surface of the heat receptor has a lower thermal emissivity than the outer surface of the heat receptor.

59. The x-ray generating device of claim 52, wherein the outer surface of the heat receptor has a higher thermal emissivity than the inner surface of the heat receptor.

60. The x-ray generating device of claim 52, wherein the heat receptor further comprises an annular heat pipe.

61. The x-ray generating device of claim 60, wherein the annular heat pipe comprises an evacuated sealed metal chamber partially filled with a fluid.

62. The x-ray generating device of claim 60, wherein the annular heat pipe comprises an evaporator end and a condenser end, the evaporator end positioned proximal to the first end of the heat receptor and the condenser end positioned proximal to the second end of the heat receptor.

63. The x-ray generating device of claim 52, wherein the heat receptor further comprises a plurality of axially-aligned linear heat pipes disposed within the heat receptor.

64. The x-ray generating device of claim 63, wherein each of the plurality of heat pipes comprises an evacuated sealed metal chamber partially filled with a fluid.

65. The x-ray generating device of claim 63, wherein each of the plurality of heat pipes comprises an evaporator end and a condenser end, the evaporator end positioned proximal to the first end of the heat receptor and the condenser end positioned proximal to the second end of the heat receptor.

66. An x-ray system, comprising:

a vacuum vessel having an inner surface forming a vacuum chamber;

an anode assembly disposed with the vacuum chamber, the anode assembly including a target;

a cathode assembly disposed within the vacuum chamber at a distance from the anode assembly, the cathode assembly configured to emit electrons that strike the target of the anode assembly and produce x-rays and residual energy, said x-rays directed along a focal alignment path;

a rotatable shaft coupled to the vacuum vessel;

a bearing assembly comprising a lubricating medium disposed within the vacuum chamber, the bearing assembly providing for rotational movement of the shaft;

an annular heat receptor made of a thermally conductive material positioned between the anode assembly and the bearing assembly, the heat receptor having an inner surface with an inner diameter and an outer surface with an outer diameter, the heat receptor for absorbing an amount of the residual energy; and an annular heat exchanger in thermal communication with the heat receptor, the heat exchanger having an inlet and an exit for carrying a cooling medium, the heat exchanger for conducting an amount of the residual energy absorbed by the heat receptor away from the heat receptor.

67. The x-ray system of claim 66, further comprising a cooling plate in thermal communication with the heat receptor and the heat exchanger, the cooling plate having an inner surface and an outer surface, the inner surface proximal to the heat receptor and the outer surface proximal to the heat exchanger, the cooling plate for conducting an amount of the residual energy absorbed by the heat receptor away from the heat receptor.

68. The x-ray system of claim 66, wherein the inner diameter of the heat receptor is sized to permit the bearing assembly to be disposed within the heat receptor.

69. The x-ray system of claim 66, wherein the outer diameter of the heat receptor is sized to permit the heat receptor to be disposed within an inner bore of the anode assembly.

70. The x-ray system of claim 66, wherein said x-ray system comprises an x-ray system selected from the group consisting of mammography, radiography, angiography, computed tomography, fluoroscopy, vascular, mobile, and industrial x-ray.

* * * * *